US006131970A

United States Patent [19]

Hurst et al.

[11] Patent Number: 6,131,970

[45] Date of Patent: Oct. 17, 2000

[54] LATCH ASSEMBLY WITH KEYED ROSE PLATE FOR ADJUSTMENT TO DOORS OF DIFFERING THICKNESS

[75] Inventors: Barclay H. Hurst, Knoxville; Kerry D. Huebner, Lenoir City; J. Steven Gray, Maryville, all of Tenn.

[73] Assignee: Yale Security Inc., Monroe, N.C.

[21] Appl. No.: 08/937,533

[22] Filed: Sep. 25, 1997

[51] Int. Cl.[7] ..... E05B 3/00

[52] U.S. Cl. ..... 292/336.3; 292/DIG. 53

[58] Field of Search ..... 292/348, 352, 292/357, DIG. 53; 70/450–452

[56] References Cited

U.S. PATENT DOCUMENTS

| | | | |
|---|---|---|---|
| 43,332 | 6/1864 | Parker . | |
| 71,502 | 11/1867 | Munger . | |
| 100,314 | 3/1870 | Munger . | |
| 242,861 | 6/1881 | Barnes . | |
| 365,878 | 7/1887 | Steller . | |
| 420,528 | 2/1890 | Young . | |
| 1,994,134 | 3/1935 | Henst . | |
| 2,702,720 | 2/1955 | Young | 292/357 |
| 2,751,244 | 6/1956 | McConnell | 292/358 |
| 2,904,989 | 9/1959 | Best . | |
| 3,042,437 | 7/1962 | Duvall | 292/358 |
| 3,093,400 | 6/1963 | Williams | 292/1 |
| 3,427,061 | 2/1969 | McMeen et al. | 292/353 |
| 3,608,939 | 9/1971 | McBurnie et al. | 292/254 |
| 3,985,008 | 10/1976 | Hart | 70/224 |
| 4,037,865 | 7/1977 | Hook | 292/357 |
| 4,186,952 | 2/1980 | Glass | 292/202 |
| 4,604,879 | 8/1986 | Neary et al. | 70/224 |
| 4,869,083 | 9/1989 | DeMarseilles et al. | 70/224 |
| 4,921,289 | 5/1990 | Shen | 292/336.3 |
| 4,930,822 | 6/1990 | Shen | 292/357 |
| 4,976,480 | 12/1990 | Dixon et al. | 292/353 |
| 4,995,652 | 2/1991 | Mugnolo | 292/202 |
| 5,123,682 | 6/1992 | Robida et al. | 292/169 |
| 5,141,269 | 8/1992 | Haq et al. | 292/169 |
| 5,149,155 | 9/1992 | Caeti et al. | 292/336.3 |
| 5,265,924 | 11/1993 | Kim | 292/336.3 |
| 5,322,333 | 6/1994 | Norton, II et al. | 292/336.3 |
| 5,335,948 | 8/1994 | Norton, II et al. | 292/169.23 |
| 5,335,950 | 8/1994 | Mirshafiee et al. | 292/356 |
| 5,564,296 | 10/1996 | Theriault et al. | 70/224 |
| 5,566,996 | 10/1996 | Massey et al. | 292/357 |
| 5,590,555 | 1/1997 | Kester et al. | 70/224 |
| B1 4,920,773 | 1/1997 | Surko, Jr. | 70/224 |

*Primary Examiner*—B. Dayoan
*Assistant Examiner*—Gary Estremsky
*Attorney, Agent, or Firm*—Moore & Van Allen, PLLC; Michael G. Johnston

[57] ABSTRACT

A latch assembly with a keyed rose plate for quick and easy adjustment to doors of different thickness without the use of threaded components. The latch assembly includes a latch body with an outside end having at least two grooves. The grooves are preferably spaced longitudinally apart from one another by one-half (½)the difference in standard door thickness. An outside rose plate has an oblong central opening which allows it to fit eccentrically over the outside end of the latch body. Once aligned with one of the grooves, the outide rose plate may be moved laterally with respect to the latch body to engage in the groove with which it is so aligned. An inside rose plate fits over the inside end of the latch body so that the inside rose plate is free to move longitudinally along the inside end of the latch body. By engaging the outside rose plate in the appropriate groove for the door thickness and fixing the rose plates to one another and snug against the door, the latch body is maintained in the center of the door. The engagement of the outside rose plate in one of the grooves secures the rose plate axially and rotationally with respect to the latch body.

1 Claim, 3 Drawing Sheets

LATCH ASSEMBLY WITH KEYED ROSE PLATE FOR ADJUSTMENT TO DOORS OF DIFFERING THICKNESS

BACKGROUND

The present invention relates to a door latch assembly which is easily adjusted for mounting on doors of differing thickness. More specifically, such adjustment is effected in a way that provides the assembly with inherent strength and avoids the need for threading on components. The latch assembly may include means for locking the door, such as a well-known cylinder door lock.

Passage sets and lock sets generally comprise a housing having spindles extending centrally outward from either side. The housing is adapted to be disposed in an opening through the door and includes a mechanism for latching the door closed. On the outside of the door a handle and rose assembly fit onto the housing such that the handle cooperates with one of the spindles of the housing to operate the latch. The rose assembly is threaded on the outside of the housing and held from rotation by engagement with the door.

On the inside of the door, the handle has a rose liner provided with openings to receive bolts which extend into the housing. In assembly, the liner is bolted to the housing. A rose scalp is brought over the spindle and affixed to the liner, and the handle is then snapped into place over the spindle. Alternatively, the inside rose may be an assembly which is threaded onto the inside spindle to pull the rose tightly against the door. The handle is then assembled over the spindle.

Mounting the passage or lock set has typically involved the steps of adjusting the position of the outside handle and rose assembly on the outer spindle according to the thickness of the door. The inside rose liner is then threaded onto the inside spindle or is bolted onto the cylindrical housing until the liner is snug against the door. The mounting will require more or less threading or bolting of the inside rose plate onto its spindle depending on the thickness of the door. This conventional latch installation involves the manipulation of several parts and takes considerable time. It also requires threading on certain components and other structure to provide the necessary rotational stability to the assembly, all of which adds cost.

Since the passage of the Americans with Disabilities Act (ADA) which requires equal access for handicapped persons, lever handles have become prevalent on doors. Lever handles provide the user with the ability to apply much greater torque to door latch and lock assemblies, requiring developments in passage set technology to withstand such forces.

Another recurring concern with regard to passage sets is the requirement for mounting on doors of differing thickness. As described above, this has traditionally been accomplished through the use of threaded components.

SUMMARY

Therefore, in light of the disadvantages and drawbacks of the prior art, the latch assembly of the present invention is provided with two or more lateral grooves in the outside portion of the latch body. These grooves are preferably spaced apart from one another by one-half (½) the difference in thickness of standard residential doors. The outside rose plate has an opening which fits over the end of the latch body. The shape of the opening allows the outside rose plate to be moved laterally to engage in one of the grooves. The rose plate is selectively engaged in the groove furthest from the center of the latch body for thick doors and in the groove nearest the center of the latch body for thin doors.

Once the rose plate is so engaged, the assembly can proceed by securing the rose support, rose scalp and handle on the outside of the door. The inside assembly is similarly accomplished but without the use of grooves. The inside rose plate fits freely over the inside end of the latch body. With the inside rose plate snug against the door and the outside rose plate engaged in the appropriate groove for the door thickness, the latch body is centered within the door. The assembly is completed by securing the inside and outside rose supports together through the door and adding the inside rose scalp and handle. Once assembled, the latch body is secured both axially and rotationally with respect to the door and to the remainder of the assembly.

As will become apparent below, the present invention addresses the concerns of simplicity of installation and strength with a single development, that of engaging the rose plate in either one of preferably two grooves in the latch body. The present invention provides a latch assembly which may be quickly and simply adjusted to doors of differing thickness without the need for threaded components. Such adjustment also provides for the rotational and axial retention of the assembly within the door without the need for additional structural components and in a configuration which is inherently stronger than prior art assemblies. At the same time, the present invention reduces two additional, overriding concerns which apply to almost any commercial technology: cost of manufacture and time required for assembly.

It is an object of the present invention to provide a latch assembly which is easily adjusted to doors of differing thickness.

It is another object of the present invention to provide a latch assembly which is strong enough to withstand the considerable torque generated by modem lever handled doors.

It is yet another object of the present invention to provide a latch assembly which is less expensive to manufacture because it has fewer components and requires less machining.

BRIEF DESCRIPTION OF THE DRAWINGS

The accompanying drawings which form a part of the specification, illustrate a preferred embodiment of the present invention. The drawings and description together serve to fully explain the invention. In the drawings, like reference numbers are used to designate the same or similar items throughout the several figures wherein.

DESCRIPTION

Figure 1:
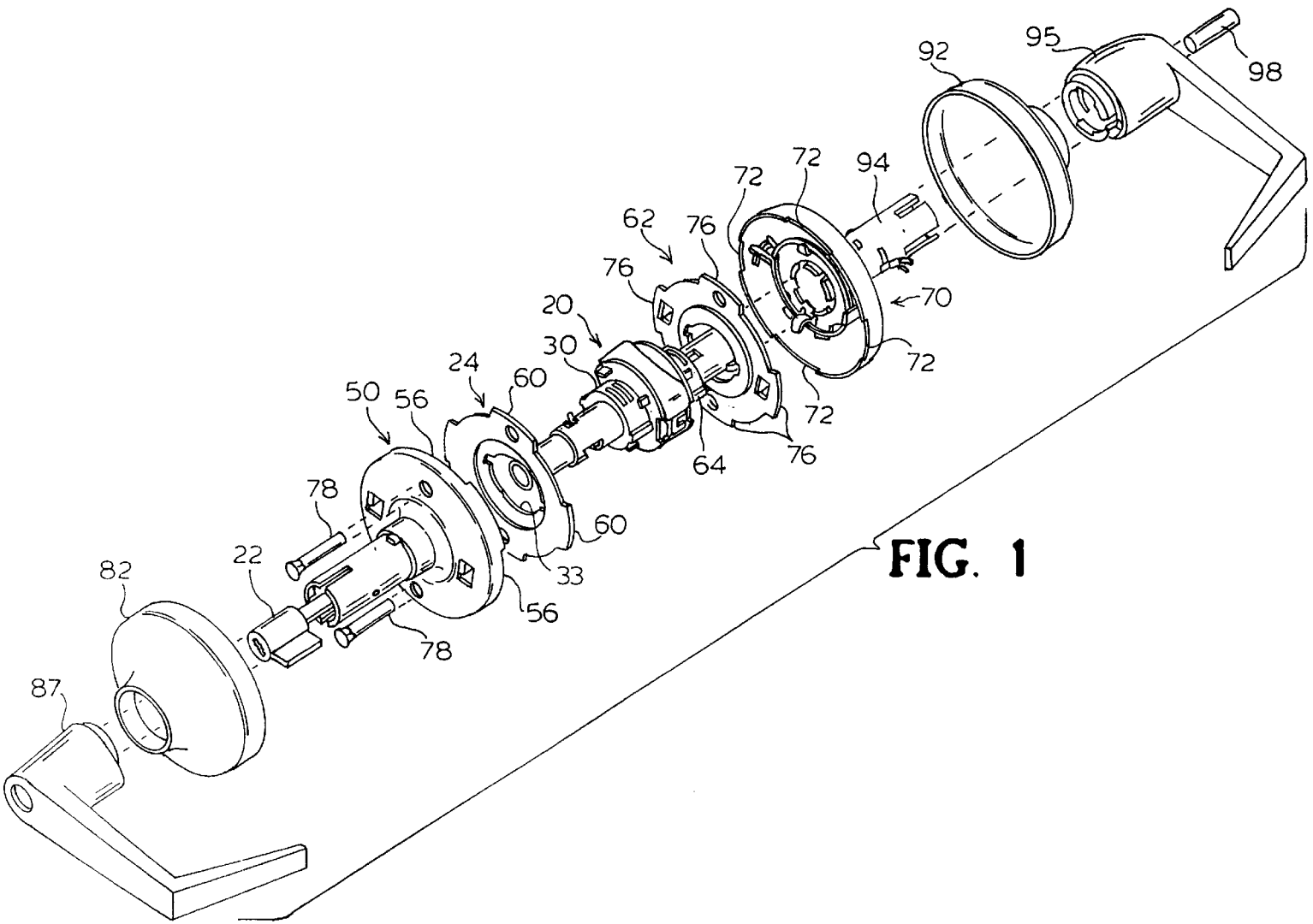
FIG. 1 is an exploded assembly view of the preferred embodiment of the invention, showing an included cylinder lock and lever handles.

FIG. 1 illustrates an exploded view of an embodiment of the present invention for use with a conventional lock opening in a door (not shown). In this embodiment, a latch body 20 is shown, including a cylinder lock 22.

It is understood, however, that the interior construction of the latch body is not critical to the present invention and, for purposes of illustration, may be as described in U.S. Pat. No. B1 4,920,773 to W. E. Surko, Jr., the disclosure of which is hereby incorporated by reference. As described in detail in the incorporated U.S. patent, the passage set includes a latch in the latch body which has engaged and disengaged states and operating means, such as a doorknob, a lever handle or the like, to disengage the latch and allow the door to be opened.

Figure 2:
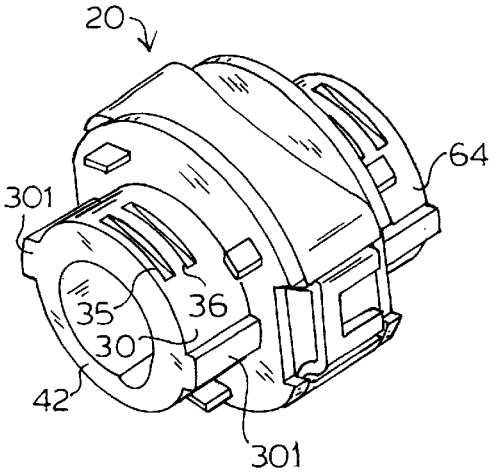
FIG. 2 is a close-up perspective view of the latch body showing two longitudinally-spaced lateral grooves.
Figure 5:
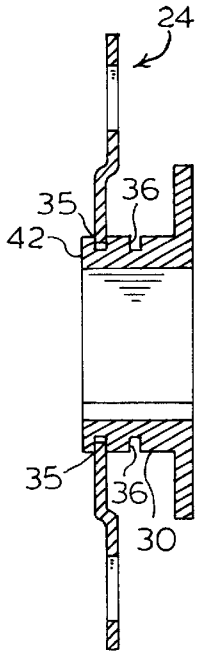
FIG. 5 is a cross section taken along the line 5—5 in FIG. 3.

According to the present invention, the latch body 20 is inserted The latch body 20 includes an outside end 30 and an inside end 64. As seen in FIG. 2, both ends 30,64 of the latch body 20 have longitudinally-spaced lateral grooves for receiving rose plates 24,62. In the preferred embodiment only the outside rose plate 24 is adapted to be engaged in either one of two grooves 35,36 in the outside end 30 of the latch body 20. However, it is understood that the present invention is not so limited and that either, or both, of the rose plates 24,62 may be adapted to engage in the grooves in the latch body 20 to accommodate different door thicknesses. It is understood that, in the preferred embodiment, the outside end 30 of the latch body 20 includes two sets of longitudinally-spaced lateral grooves 35, 36, each set including two diametrically opposed grooves (FIG. 5).

Figure 3:
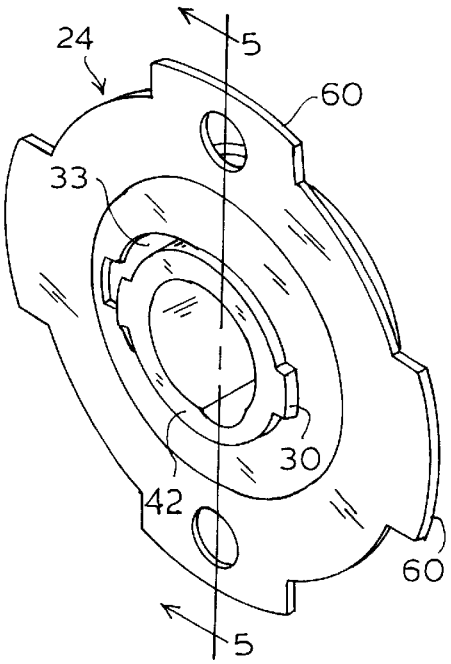
FIG. 3 is a perspective view of the rose plate engaged in the outermost groove in the latch body.
Figure 4:
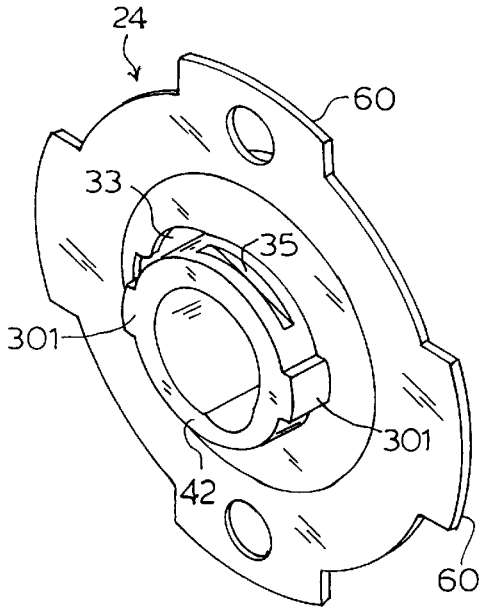
FIG. 4 is a perspective view of the rose plate engaged in the innermost groove in the latch body.
Figure 6:
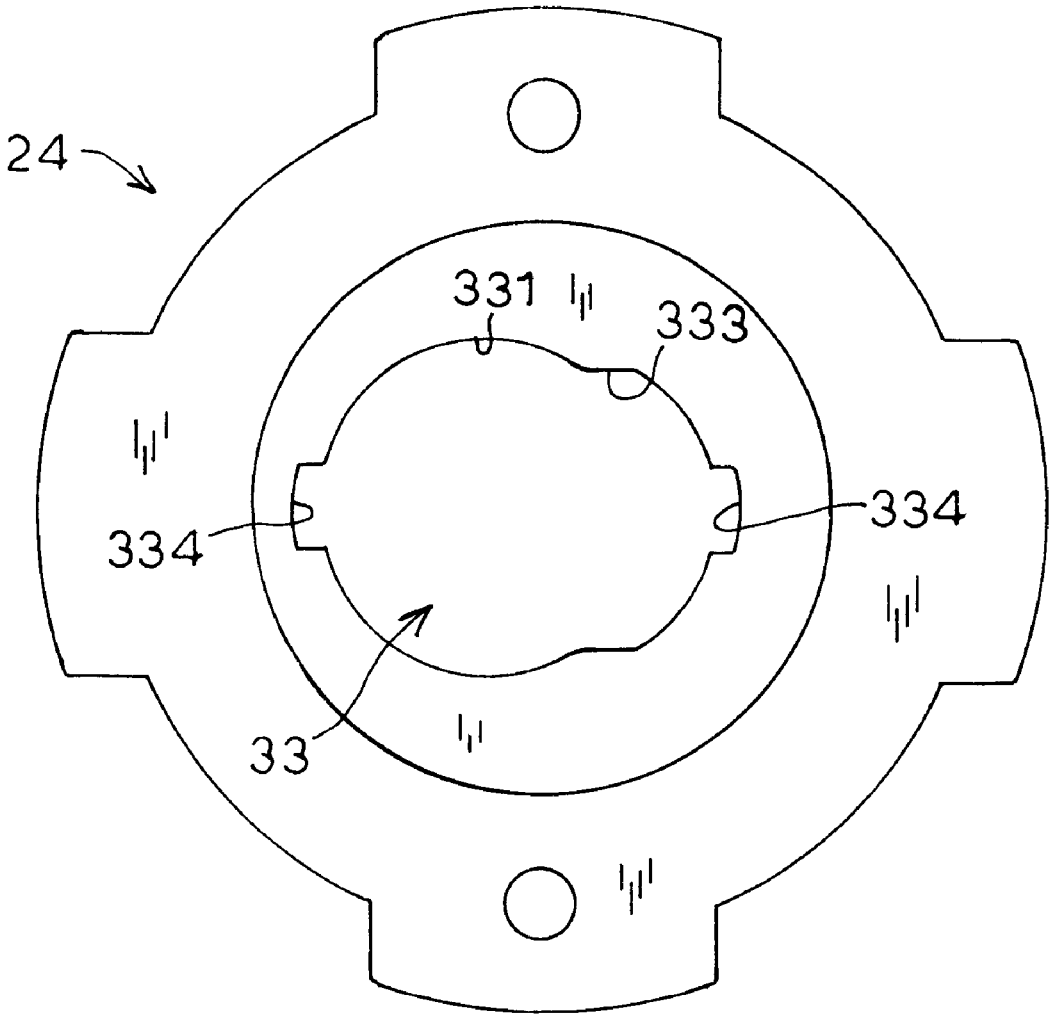
FIG. 6 is a flat plan view of the outside rose plate.

In the preferred embodiment, the outside rose plate 24 is slid over the outside end 30 of the latch body 20. The outside rose plate 24 has an oblong central opening 33 (See FIG. 6) The oblong central opening 33 has a larger portion 331 of sufficient dimension to allow the rose plate to fit over the outside end 30 of the latch body 20. The oblong central opening 33 also has two opposed flats 332 which define a narrower portion 333 of the oblong central opening 33. This shape of the oblong central opening 33 allows the outside rose plate 24 to be assembled eccentrically with respect to the latch body 20 with the narrower portion 333 of the oblong central opening 33 centered over the latch body 20 and the flats 332 seated in one set of grooves. The outside rose plate 24 is aligned with the appropriate groove in the latch body 20, the outermost groove 35 (see FIG. 2) for a thick door or the innermost groove 36 for a thin door, and moved laterally to a concentric position with respect to the latch body 20 so that the mat 332 of the narrower portion 333 so the oblong central opening 33 engage one set of the grooves 35 or 36, according to the thickness of the door (not shown). FIGS. 3 and 4 show the outside rose plate 24 engaged in the outermost groove 35 and the innermost groove 36, respectively, with an outside end surface 42 of the latch body 20 extending through the oblong opening 33 in the outside rose plate 24. Once the outside rose plate 24 is so engaged, the latch body 20 is fixed rotationally and axially with respect to the outside rose plate 24. In the preferred embodiment, the outside end 30 of the latch body 20 also includes opposed longitudinal ribs 301 (See FIG. 2) and the oblong central opening 33 in the outside rose plate 24 includes opposed notches 334 (See FIG. 6). Each of the notches 334 is adapted to receive the corresponding longitudinal rib 301 when the outside rose plate 24 is engaged in either of the sets of grooves 35, 36 as described above (SEE FIG. 3 and FIG. 4). This configuration further strengthens the assembly against rotation of the outside rose plate 24 with respect to the latch body 20.

The outside rose support 50 is then fitted over the outside rose plate 24, with notches 56 in the outside rose support 50 fitting over extensions 60 on the periphery of the outside rose plate 24.

The inside rose plate 62 is fitted over an inside end 64 of the latch body 20. An inside rose support 70 is fitted over the inside rose plate 62 with notches 72 in the inside rose support 70 fitting over extensions 76 on the periphery of the inside rose plate 62.

In the preferred embodiment, the inside rose plate 62 fits over the inside end 64 of the latch body 20 so that the inside rose plate 62 is free to move longitudinally. In this way, the inside rose plate 62 can be positioned against the door when the outside rose plate 24 is moved from one of the grooves 35,36 to the other. The grooves are preferably spaced apart by one-half (½) the difference in standard door thickness so that when the rose plates 24,62 are snug against the door the distance between the two rose plates 24,62 will have been adjusted by the full difference in standard door thickness. If the outside rose plate 24 has been engaged in the appropriate groove 35,36 for the door thickness, the latch body 20 will thus be maintained in the center of the door.

The preferred embodiment shows two set of grooves 35,36 on the latch body, positioned to accommodate the most common door thicknesses in the United States, 1⅜ inches and 1¾ inches. However, it is understood that the present invention is not so limited and that more or different grooves could be utilized to accommodate any or all door thicknesses. It is understood that, in the preferred embodiment, the outside end 30 of the latch body 20 includes two sets of longitudinally-spaced lateral grooves 35, 36, each set including two diametrically opposed grooves (FIG. 5).

This arrangement, and the engagement of the outside rose plate 24 in one of the grooves 35,36 is then fixed by securing the outside and inside rose supports 50,70 to one another through the door using screws 78, as shown, or bolts or other appropriate fixing means.

To complete the assembly, an outside rose scalp 82 is then fitted over an outside sleeve portion 84 of the outside rose support 50 and an outside handle 87 is secured onto the outside sleeve 84. Similarly, an inside rose scalp 92 is placed over a sleeve portion 94 of the inside rose support 70 and an inside handle 95 is secured onto the inside sleeve 94. The inside handle 95 shows an optional locking operator in the form of a push-button 98 for the optional cylinder lock 22 shown in FIG. 1.

While the form of the apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A latch assembly to be mounted in doors of different thickness, the latch assembly comprising:

a latch body, an end of the latch body having a plurality of longitudinally spaced lateral grooves and at least one longitudinal rib; and a rose plate having an opening which fits over the end of the latch body and which opening comprises at least one notch adapted to receive the at least one longitudinal rib, the shape of the opening in the rose plate being adapted to allow the rose plate to move laterally with respect to the latch body when the rose plate is aligned with one of the plurality of grooves causing the rose plate to engage in the one groove and the at least one rib to be received in the at least one notch to fix the position of the rose plate longitudinally and rotationally with respect to the latch body.

* * * * *